US005277262A

United States Patent [19]

Huber et al.

[11] Patent Number: 5,277,262

[45] Date of Patent: Jan. 11, 1994

[54] HYDRAULIC SAFETY PIN AND METHOD OF OPERATING A PRESSURE-CONTROLLED DEVICE

[75] Inventors: Klaus B. Huber, Sugar Land; A. Glen Edwards, Hockley; Edward G. Smith, Jr., San Leon, all of Tex.

[73] Assignee: Schlumberger Technology Corporation, Houston, Tex.

[21] Appl. No.: 909,259

[22] Filed: Jul. 6, 1992

[51] Int. Cl.[5] ..... E21B 43/112; E21B 34/10; E21B 43/1185

[52] U.S. Cl. ..... 175/4.54; 166/316; 166/375

[58] Field of Search ..... 175/4.54; 166/319, 316, 166/332, 375, 374

[56] References Cited

U.S. PATENT DOCUMENTS

| | | | |
|---|---|---|---|
| 4,431,051 | 2/1984 | Adams, Jr. | 166/375 X |
| 4,531,590 | 7/1985 | Peterson | 175/4.56 X |
| 4,624,315 | 11/1986 | Dickson et al. | 166/375 X |
| 4,924,952 | 5/1990 | Schneider | 175/4.56 X |
| 5,165,480 | 11/1992 | Wagoner et al. | 166/375 |
| 5,165,489 | 11/1992 | Langston | 175/4.54 |
| 5,180,015 | 1/1993 | Ringgenberg | 166/375 X |

*Primary Examiner*—Stephen J. Novosad
*Attorney, Agent, or Firm*—Henry N. Garrana; John H. Bouchard

[57] ABSTRACT

A hydraulic safety pin is interconnected between a device, such as a pressure controlled firing head associated with a perforating gun, and a small diameter tubing in a wellbore. When, the small diameter tubing is filled with fluid under pressure, the hydraulic safety pin allows the fluid to fill the small diameter tubing but prevents the pressure of the fluid in the small diameter tubing from accidentally detonating the firing head when the pin is disposed in a first position; however, when the tubing is already filled with fluid under pressure, the hydraulic safety pin allows the pressure of the fluid in the small diameter tubing to detonate the firing head when the pin is disposed in a second position. The hydraulic safety pin may be installed in a special coupling, and multiple special couplings may be used in a tool string disposed in a wellbore.

17 Claims, 3 Drawing Sheets

FIG. 1
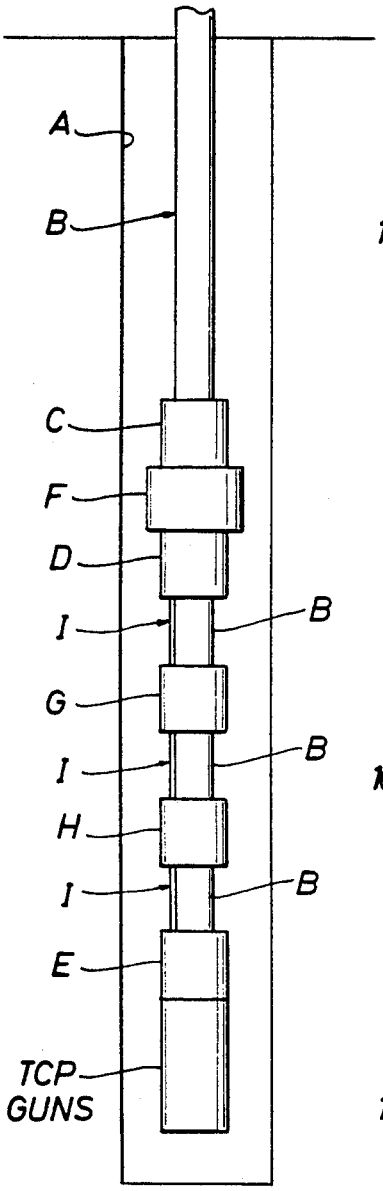
FIG. 2A
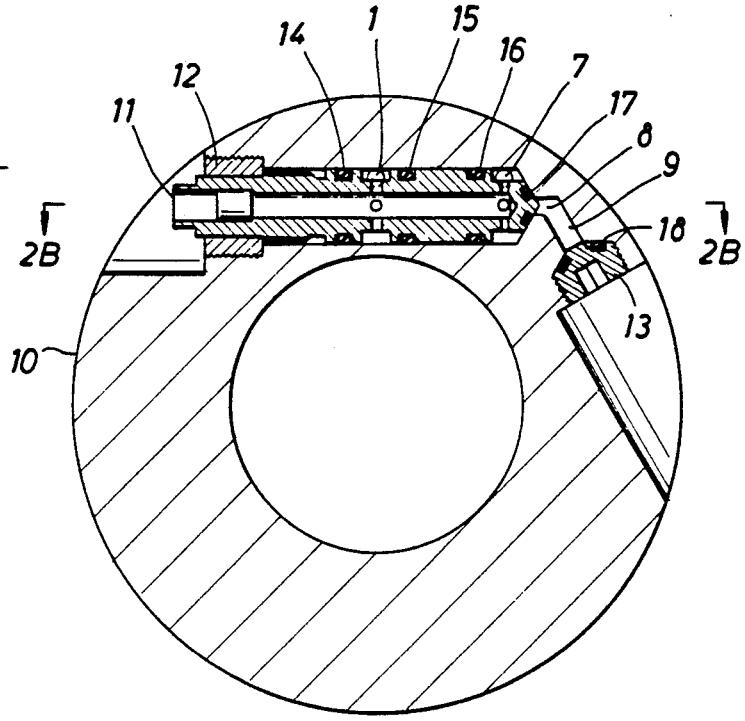
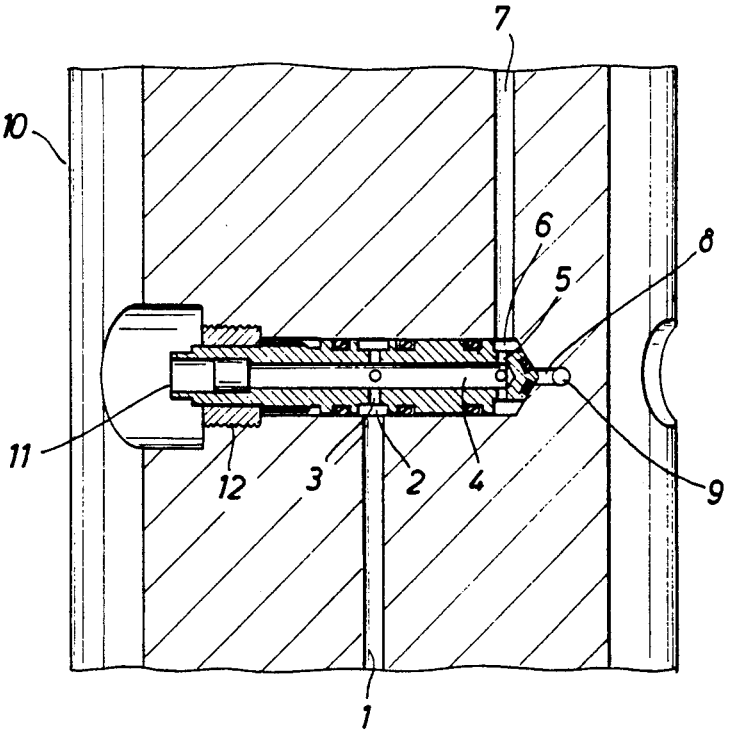
FIG. 2B

FIG. 1A
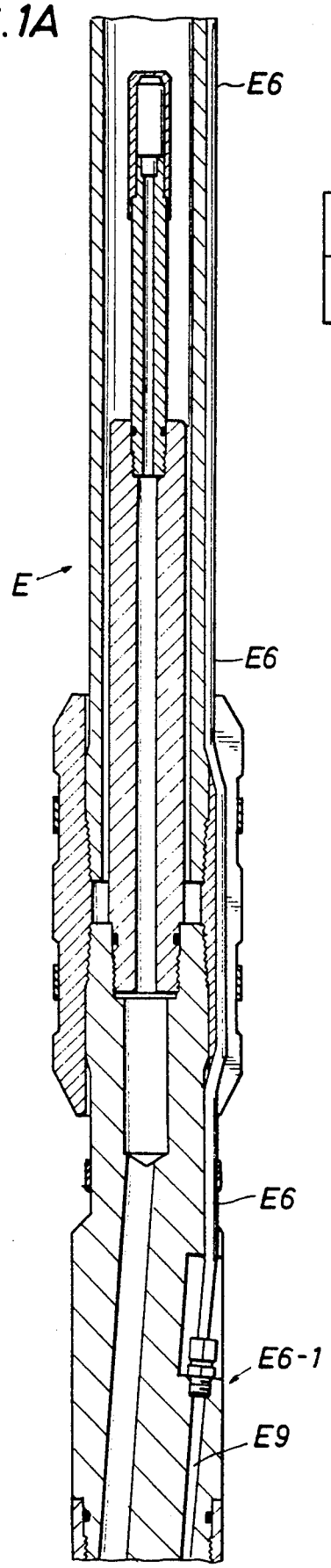
FIG. 1A
FIG. 1B
FIG. 1B
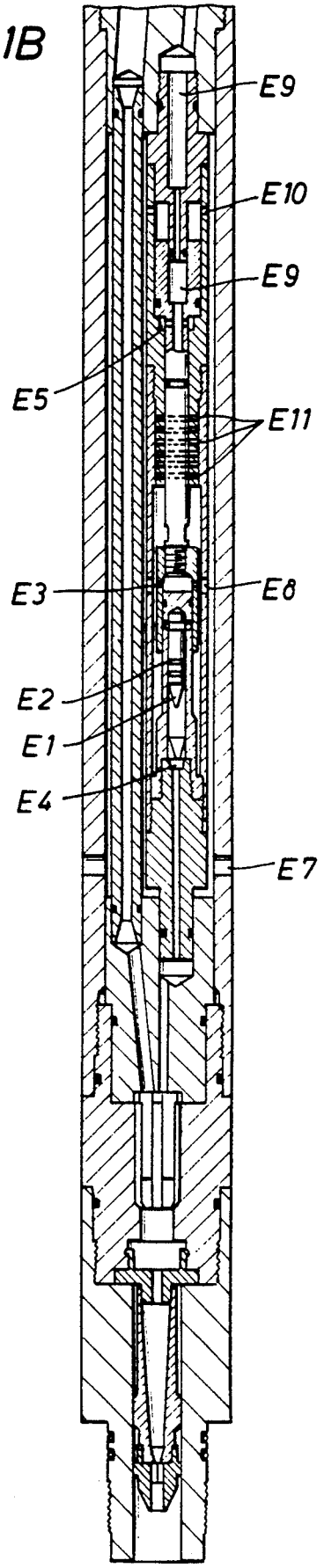

HYDRAULIC SAFETY PIN AND METHOD OF OPERATING A PRESSURE-CONTROLLED DEVICE

BACKGROUND OF THE INVENTION

The subject matter of the present invention relates to a hydraulic safety pin apparatus adapted to be connected between a small diameter tubing and a pressure controlled device in a wellbore for allowing long lengths of the small diameter tubing to be filled with a clean fluid under pressure without also allowing the pressure of the fluid to control or operate the pressure controlled device.

While long lengths of small diameter tubing are used in various downhole applications (such as in connection with operation of safety valves), the bottom of the tubing is normally connected to a device that contains no explosives. As a result, the tubing may be filled with fluid under pressure; and, since the device contains no explosives, one need not be concerned about accidental detonation of the device. However, if a pressure controlled device containing explosives is connected to the bottom of the tubing, when the tubing is filled with fluid under pressure, the pressure of the fluid may accidentally detonate the device. Therefore, an apparatus is needed, which is adapted to be connected between the pressure controlled device and the tubing, for allowing the tubing to be filled with fluid under pressure without simultaneously allowing the pressure of the fluid in the tubing to accidentally detonate or operate the device.

When the device was a tubing conveyed perforating gun having a differential pressure firing head, a prior art mechanical safety pin, connected to the firing head, prevented the firing head from detonating while the perforating gun was assembled at the surface provided that the mechanical safety pin was held firmly in place. A small diameter tubing, connected to the perforating gun, could then be filled safely with water or other fluid. After the small diameter tubing was filled with fluid but prior to detonating the firing head, a drilling rig lifted or removed the firing head from the wellbore so that the mechanical safety pin, connected to the firing head, could be manually removed from the firing head at the rig floor. However, the mechanical safety pin limited the length of the small diameter tubing since the distance along the small diameter tubing, between the firing head and the top of the small diameter tubing, was limited to a length that the drilling rig could lift or pick up in a single lift (usually 90 to 100 feet).

SUMMARY OF THE INVENTION

Accordingly, it is a primary object of the present invention to provide an apparatus, adapted to be connected between a pressure controlled device and a small diameter tubing, for allowing the tubing to be filled with a clean fluid under pressure without simultaneously allowing the pressure of the fluid in the tubing to accidentally detonate or operate the device.

It is a further object of the present invention to provide a hydraulic safety pin, adapted to be connected between a pressure controlled device and a small diameter tubing, for allowing the tubing to be filled with a clean fluid under pressure without also allowing the pressure of the fluid in the tubing to detonate or operate the device when the safety pin is disposed in one position and for allowing the pressure of the fluid in the tubing to detonate or operate the device when the safety pin is disposed in another position.

In accordance with these and other objects of the present invention, a hydraulic safety pin is interconnected between a device, such as a pressure controlled firing head associated with a perforating gun, and a small diameter tubing in a wellbore. When the device is the pressure controlled firing head, the firing head is normally armed with explosives necessary to detonate the perforating gun. The small diameter tubing is stored on reels disposed at the surface of the wellbore, and is unreeled from the reel and connected to the safety pin prior to running-in the hole. Sometimes, the small diameter tubing includes one or more crimped, flattened, or bent portions. If a safety pin is not disposed between the tubing and the firing head while filling the small diameter tubing with a clean fluid, pressure can build up in the tubing resultant from the crimped, flattened or bent portions of the tubing and may accidentally detonate the firing head. On the other hand, if a safety pin is disposed between the tubing and the firing head, when the tubing is filled with fluid under pressure, the hydraulic safety pin allows the fluid to fill the tubing but prevents the pressure of the fluid from accidentally detonating the firing head when the pin is disposed in a first position; however, when the tubing is already filled with fluid under pressure, the hydraulic safety pin allows the pressure applied to the fluid in the small diameter tubing to detonate the firing head when the pin is disposed in a second position. The hydraulic safety pin may be installed in a special coupling; when a multiple number of special couplings are installed in a tool string, a corresponding multiple number of stands of spacer tubing may also be installed in the tool string, thus allowing for great distances between the packer and the firing head.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 1 illustrates a tool string adapted to be disposed in a wellbore including a plurality of couplings, one or more perforating guns, and a differential pressure firing apparatus for detonating the perforating guns, each coupling including the hydraulic safety pin in accordance with the present invention;

FIGS. 1A and 1B illustrate the firing head of FIG. 1 without the hydraulic safety pin of the present invention;

FIGS. 2A–2B illustrate the hydraulic safety pin of the present invention disposed in the run-in or firing position, FIG. 2A illustrating the hydraulic safety pin in one of the couplings of FIG. 1 shown in a transverse cross section, and FIG. 2B illustrating the hydraulic safety pin of FIG. 2A shown in cross section taken along section lines 2B—2B of FIG. 2A;

DETAILED DESCRIPTION OF THE PREFERRED EMBODIMENT

Figure 3A:
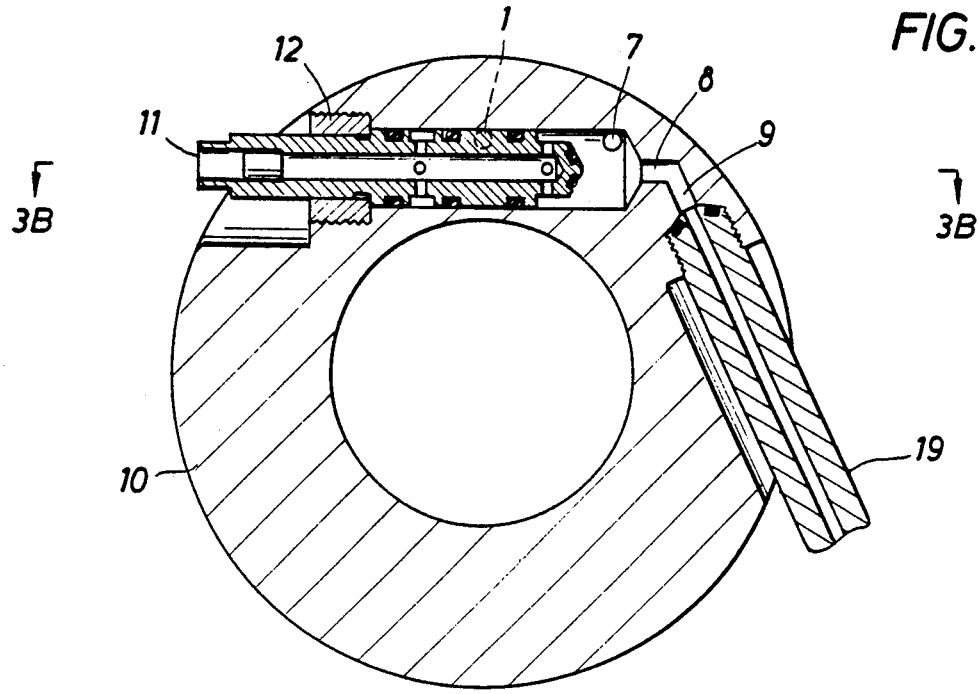
FIGS. 3A-3B illustrate the hydraulic safety pin of the present invention disposed in the safety position, FIG. 3A illustrating the hydraulic safety pin of FIG. 2A in one of the couplings of FIG. 1 shown in transverse cross section with a fill nipple 19 installed in place of a plug 13, and FIG. 3B illustrating the hydraulic safety pin of FIG. 3A shown in cross section taken along section lines 3B—3B of FIG. 3A.

Referring to FIG. 1, a tool string is disposed in a wellbore A.

The tool string includes a tubing B; a differential pressure firing (DPF) Operator Assembly C connected to the tubing B; a DPF Receptacle Assembly D; a packer F disposed between the DPF Operator Assembly C and the DPF Receptacle Assembly D; a first coupling G, which includes a hydraulic safety pin in accordance with the present invention, connected to the receptacle assembly D via a first stand of the tubing B; a second coupling H, which includes the hydraulic safety pin of the present invention, connected to the first coupling G via a second stand of the tubing B; a firing head E, which includes the hydraulic safety pin of the present invention, connected to the second coupling H via a third stand of the tubing B; and one or more tubing conveyed perforating (TCP) guns. A small diameter tubing I runs down the outside of and along the length of the stands of tubing B in FIG. 1, a small diameter tubing I being disposed between firing head E and second coupling H, between second coupling H and first coupling G, and between first coupling G and the DPF Receptacle Assembly D (the small diameter tubing I is illustrated again in and discussed with reference to FIGS. 1A and 1B). The small diameter tubing I is filled with water or other fluid at the wellbore surface. When the small diameter tubing I is filled with the water or fluid, the water or fluid enters the small diameter tubing I from its bottom and travels upwardly thereby removing any air that exists within the tubing I. When pressure is applied to the water or fluid in the small diameter tubing I from the wellbore surface, fluid communication between the rathole annulus and firing head E disposed below packer F is closed off and fluid communication between the annulus above the packer F and firing head E is opened. For more information about the function of the small diameter tubing I in connection with the DPF Operator Assembly C, the Receptacle Assembly D, the Packer F, and the firing head E, refer to U.S. Pat. No. 5,191,933 to Edwards et al which corresponds to prior pending application Ser. No. 07/877,340, filed May 1, 1992, entitled "Wellbore Apparatus including a Rathole Pressure Balanced Differential Pressure Firing System", the disclosure of which is incorporated by reference into this specification.

Let us assume that the tool string of FIG. 1 does not include any hydraulic safety pins. In that case, the first coupling G, the second coupling H, and the safety pin within firing head E are not present in FIG. 1. Therefore, since a hydraulic safety pin is not connected in series between the small diameter tubing I and the firing head E of FIG. 1 when the small diameter tubing is filled with water or fluid at the wellbore surface, the pressure of the fluid present within the small diameter tubing I may accidentally detonate the firing head E.

However, if a hydraulic safety pin is connected in series between the small diameter tubing I and the firing head E when the small diameter tubing is filled with water or fluid, the pin will prevent the pressure of the fluid in the small diameter tubing I from accidentally detonating the firing head E. When fluid communication between the small diameter tubing I and the firing head E is required, the safety pin is moved from a first position which blocks fluid communication to a second position which establishes fluid communication. This concept will be more fully understood in the following discussion with reference to FIGS. 1A and 1B.

Referring to FIG. 1A and 1B, a more detailed construction of the firing head E of FIG. 1, without the hydraulic safety pin of the present invention, is illustrated. The firing head E of FIGS. 1A and 1B is shown and discussed in more detail in the aforementioned U.S. Pat. No. 5,191,933 to Edwards et al entitled "Wellbore Apparatus including a Rathole Pressure Balanced Differential Pressure Firing System", the disclosure of which has already been incorporated by reference into this specification.

In FIGS. 1A and 1B, the firing head E includes a firing pin E1 which is held in place by a pair of locking balls E2. The locking balls E2 are held firmly in a recess around the firing pin E1 by a sleeve E3. When the sleeve E3 moves up and over the locking balls E2, the balls E2 fall out of the recess, and the firing pin E1 impacts a booster E4 which ultimately detonates a perforating gun. The sleeve E3 moves up and over the locking balls E2 when a predetermined differential pressure (P2 − P1) exists. Pressure P2 exists within space E5, the pressure P2 propagating down a small diameter tubing E6 which leads to space E5 via channels E9. Pressure P1 is propagated to sleeve E3 from a rathole annulus via ports E7, E8 and E10. When pressure P2 is greater than pressure Pl by an amount sufficient to break shear pins E11, the sleeve E3 moves over the locking balls E2 and the locking balls E2 fall out of its recess which allows the firing pin E1 to impact the booster E4.

Note in FIG. 1A that no hydraulic safety pin exists in series with the small diameter tubing E6. Recall that the small diameter tubing E6 is filled with water or fluid, from bottom upwardly, when the tubing E6 is disposed at the wellbore surface. When the small diameter tubing is filled with fluid, the firing head E is lowered into the wellbore. The water or fluid within the small diameter tubing E6 is then pressurized with pressure P2; and, if pressure P2 is greater than pressure P1, the differential pressure detonates the perforating gun. Assume, in FIG. 1A, that a point E6-1 exists along small diameter tubing E6 where the water or fluid enters the tubing E6 during the filling process.

The water or fluid enters point E6-1 of small diameter tubing E6 and flows upwardly in FIG. 1A. Air in the small diameter tubing E6 is displaced out of the tubing E6. However, in FIG. 1A, since no hydraulic safety pin exists below point E6-1 in series with small diameter tubing E6, the water or fluid is also capable of flowing downwardly. If the free upward flow of the fluid in small diameter tubing E6 is blocked by an obstruction or a damaged place in the small diameter tubing E6, thus causing an increase in pressure P2, the sleeve E3 will move up and over locking balls E2 thereby releasing firing pin El and detonating the perforating guns prematurely. On the other hand, if a hydraulic safety pin exists below point E6-1 in series with small diameter tubing E6, when the safety pin is disposed in a first position, the water or fluid, entering point E6-1 and filling tubing E6, is prevented from flowing downwardly below point E6-1 of FIG. 1A; and, when the safety pin is disposed in a second position, the water or fluid, entering point E6-1, is allowed to flow downwardly below point E6-1 of FIG. 1A. Therefore, when using a hydraulic safety pin of the present invention in series with small diameter tubing E6 below point E6-1, the perforating gun will not detonate prematurely during the filling process when water or fluid, entering point E6-1 of tubing E6 at the wellbore surface, flows upwardly and fills tubing E6.

Referring to FIGS. 2A, 2B, 3A, and 3B, a detailed construction of the hydraulic safety pin of the present invention, disposed within first coupling G, within second coupling H, and within firing head E, is illustrated.

The hydraulic safety pin of FIGS. 2A-2B is shown in the run-in or firing position, FIG. 2A showing the safety pin in transverse cross section, FIG. 2B showing the safety pin in a longitudinal cross section of FIG. 2A, FIG. 2B being a cross section taken along section lines 2B—2B of FIG. 2A.

Figure 3B:
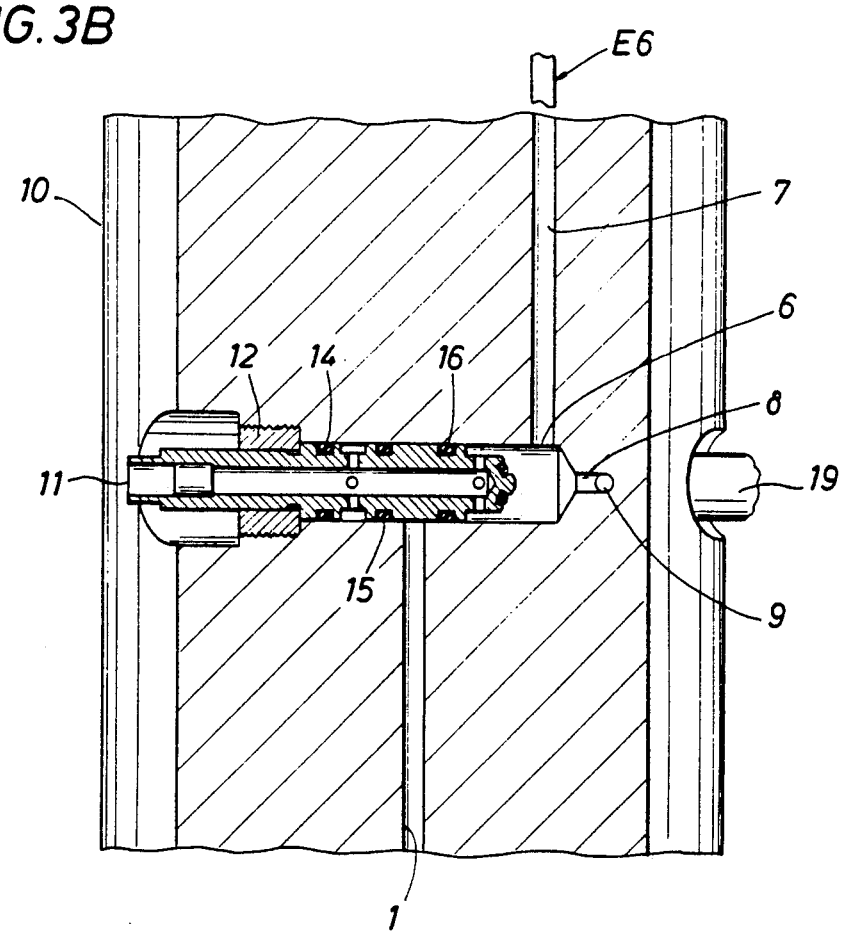

The hydraulic safety pin of FIGS. 3A-3B is shown in the safety position, FIG. 3A showing the safety pin in transverse cross section with a plug 13 of FIG. 2A replaced by a fill nipple 19, FIG. 3B showing the safety pin in a longitudinal cross section, FIG. 3B being a cross section taken along section lines 3B—3B of FIG. 3A.

In the following description, assume that the hydraulic safety pin of the present invention illustrated in FIGS. 2A, 2B, 3A, 3B is connected at point E6-1 of FIG. 1A along the small diameter tubing E6.

In FIG. 2B, a passage 1 is connected to channel E9 in FIG. 1A, and a passage 7 is connected to small diameter tubing E6 in FIG. 1A. The passage 1 from channel E9 opens into circular passage 2, and passage 2 connects with a passage 3 which opens into a passage 4. Passage 4 is intersected by a passage 5 which opens into a circular passage 6. Circular passage 6 is intersected by passage 7 which leads to the small diameter tubing E6 of FIG. 1A.

In FIG. 2A, a valve 11 is shown as disposed in the running in and/or firing position. In this position under normal circumstances, when it is time to fire the perforating gun, pressure is applied to the small diameter tubing E6 and enters the hydraulic safety pin from the top through passage 7. The pressure travels into circular passage 6, through passage 5, into passage 4, to passage 3, and into circular passage 2. From passage 2, the pressure travels into passage 1 and down to the firing head E of FIG. 1 or to the next tool down the tool string. Passages 8 and 9 are sealed off from the pressure by an o-ring 17 on one side and by a plug 13 and o-ring 18 on the other side.

A functional description of the operation of the hydraulic safety pin of the present invention will be set forth in the following paragraphs with reference to FIGS. 2A-2B, 3A-3B of the drawings.

The small diameter tubing E6 above the hydraulic safety pin may be safely filled with water or fluid as follows. FIGS. 2A and 2B illustrate the hydraulic safety pin in the run-in and firing position. When the hydraulic safety pin is disposed in the run-in and firing position, plug 13 of FIG. 2A is removed and replaced by a fill nipple 19 of FIG. 3A. Valve 11 is backed out by turning it counter-clockwise. This tightens the left hand thread between the nut 12 and the tool body 10 so that it can act as a stop for valve 11.

In FIG. 3A, valve 11 of the hydraulic safety pin is now disposed in the safety position. Since valve 11 is fully backed out, it shoulders against nut 12. O-ring 15 and o-ring 16 now seal off passage 1 from all other passages. In addition, o-ring 17 has been moved away from its seat so that now the small diameter tubing E6 connected to the top of passage 7 can be filled without applying pressure to anything connected to the bottom of passage 1 (firing head E). Fluid is slowly pumped through fill nipple 19, into passage 9 and into passage 8.

In FIG. 3B, from passage 8, the fluid goes to circular passage 6, into passage 7, and into the small diameter tubing E6. When the small diameter tubing E6 is full and all air is displaced out of the system, valve 11 is rotated clockwise until it shoulders against tool body 10. The valve 11 of the hydraulic safety pin is now disposed in the run-in and firing position. As shown in FIGS. 2A and 2B, this closes off passage 8 and re-establishes hydraulic communication between passage 1 and passage 7.

A method or procedure associated with the use of the tool string of FIG. 1 is set forth in the following paragraphs with reference to FIG. 1 and with occasional reference to FIGS. 2A-3B.

The method or procedure associated with the assembly and use of the tool string of FIG. 1 includes the following steps: (1) the firing head E and tubing conveyed perforating (TCP) guns are attached to one end of a stand of spacer tubing B, (2) a second coupling H is attached to the other end of the spacer tubing B, (3) a first section of small diameter tubing I is connected between second coupling H and firing head E, (4) the hydraulic safety pin within firing head E is set in the safety position (as shown in FIGS. 3A and 3B) and the first section of small diameter tubing I is filled, (5) after the safety pin in firing head E is re-set to the run-in position (as shown in FIGS. 2A and 2B), a further stand of spacer tubing B is attached to to second coupling H, (6) a first coupling G is attached to the other end of the further stand of spacer tubing B, (7) a second section of small diameter tubing I is connected between first coupling G and second coupling H, (8) the hydraulic safety pin in the second coupling H is set in the safety position, (9) the second section small diameter tubing I is filled with clean fluid; and (10) the hydraulic safety pin in the second coupling H is re-set to the run-in position.

More particularly, in FIG. 1, when the length of the small diameter tubing is greater than the length of pipe that a drilling rig can pick-up in a single lift, multiple hydraulic safety pins are used, each pin being mounted within a special coupling, similar to first and second couplings G and H of FIG. 1. In this case, the first lift consists of the TCP guns and firing head E that contains a hydraulic safety pin. The TCP guns and firing head E are made up and clamped at the rig floor with a dog collar clamp. The next lift, consisting of a stand of standard oil field spacer tubing B, is picked up and made up on the top of the firing head E. The hydraulic safety pin in firing head E is in the running in position as shown in FIGS. 2A and 2B. The dog collar is removed and the tool, consisting of the stand of spacer tubing B, firing head E and TCP guns, is lowered into the wellbore until the top of the lift is at the rig floor. The second coupling H containing a hydraulic safety pin is installed at the top of tubing B. A small diameter tubing I (similar to small diameter tubing E6 of FIGS. 1A, 1B) is connected to the bottom of the second coupling H (that is, connected to passage 1 of the hydraulic safety pin present within second coupling H), and the work string disposed in the wellbore is slowly lifted upwardly, stopping every 5 or 6 feet, so the small diameter tubing I may be clamped to the outside of the work string. During the lift, when the firing head E reaches the rig floor, the small diameter tubing I is cut and attached to the top of the firing head E so that it is in fluid communication with passage 7 of the hydraulic safety pin present within firing head E. Plug 13 on the hydraulic safety pin within firing head E is then replaced by fill nipple 19 and valve 11 is placed in the safety position as shown in FIGS. 3A and 3B. Passage 1 to the firing head E is now closed off and the small diameter tubing I between the firing head E and the second coupling H (which contains another hydraulic safety pin) can now be safely filled, as described above. When the small diameter tubing I between firing head E and second coupling H is full, valve 11 in the firing head E is repositioned to the run-in position shown in FIG. 2A–2B so that the small diameter tubing I above the firing head E is now in fluid communication with the differential pressure firing head itself (that is, in fluid communication with channel E9 of firing head E). The work string is then lowered into the wellbore until the second coupling H is at the rig floor. Another further pick-up length of the spacer tubing B is made up on the top of coupling H and the work string is lowered into the wellbore until the top of the further length of spacer tubing B is at the rig floor. The first coupling G containing a hydraulic safety pin is connected to the top of the further length of spacer tubing B and the small diameter tubing I between first coupling G and second coupling H is installed in the manner above described. Valve 11 of the hydraulic safety pin in the second coupling H is placed in the safety position, the small diameter tubing I between coupling H and coupling G is filled with clean fluid, valve 11 of second coupling H is then placed in the run-in position, and the above referenced procedure is repeated until the desired amount of small diameter tubing is run.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A safety pin adapted to be connected between a tubing and a pressure controlled device, comprising:

first means for defining a first passage fluidly connected to the tubing;

second means for defining a second passage fluidly connected to the pressure controlled device;

third means for defining a third passage adapted for receiving a fluid; and fluid communication means adapted to be placed in a first position and a second position and interconnected between the first means, the second means, and the third means for allowing fluid communication between the first passage and the second passage but preventing fluid communication between the first passage and the third passage when said fluid communication means is disposed in said first position, said fluid communication means preventing fluid communication between the first passage and the second passage and allowing fluid communication between the first passage and the third passage when said fluid communication means is disposed in said second position.

2. The safety pin of claim 1, wherein said pressure controlled device is a firing head.

3. The safety pin of claim 1, wherein said pressure controlled device is a firing head in a perforating gun adapted to be disposed in a wellbore.

4. A method of operating a pressure controlled device by pressurizing a fluid disposed in a tubing, a safety pin adapted to be placed in a first position and a second position being connected between said tubing and said device, said safety pin including first means for defining a first passage adapted to be connected to said tubing, second means for defining a second passage adapted to be connected to said device, and fill nipple means for defining a third passage adapted to receive a fluid and fill said tubing with said fluid, said safety pin closing off fluid communication between said first passage and said second passage and opening fluid communication between said third passage and said first passage when said safety pin is placed in said first position, said safety pin opening fluid communication between said first passage and said second passage and closing off fluid communication between said third passage and said first passage when said safety pin is placed in said second position, comprising the steps of:

placing said safety pin in said first position thereby closing off fluid communication between said tubing and said device and opening fluid communication between said fill nipple means and said tubing;

filling said tubing with said fluid via said fill nipple means when said safety pin is placed in said first position;

placing said safety pin in a second position thereby opening fluid communication between said tubing and said device and closing off fluid communication between said fill nipple means and said tubing; and pressurizing said fluid in said tubing, said pressure controlled device operating in response to the pressure.

5. The method of claim 4, wherein the pressure controlled device is a perforating gun, said gun including a firing head, said pressure detonating said firing head, said perforating gun detonating in response to the detonation of said firing head.

6. Apparatus including a device adapted to be disposed in a wellbore, comprising:

a first stand of tubing having one end connected to said device;

a first coupling connected to the other end of said first stand of tubing;

a first further tubing interconnected between said first coupling and said device and disposed along an exterior surface of said first stand of tubing;

a second stand of tubing having one end connected to said first coupling; and a second further tubing having one end connected to said first coupling and disposed along an exterior surface of said second stand of tubing, said first coupling including pin means adapted to be disposed in a first position and a second position for fluidly connecting said second further tubing to said first further tubing when disposed in said first position and fluidly disconnecting said second further tubing from said first further tubing when disposed in said second position.

7. The apparatus of claim 6, wherein said pin means comprises a rotatable elongated member adapted to be rotated between said first position and said second position.

8. The apparatus of claim 6, further comprising:

a second coupling connected to the other end of said second further tubing and said second stand of tubing;

a third stand of tubing having one end connected to said second coupling; and a third further tubing having one end connected to said second coupling and disposed along an exterior surface of said third stand of tubing, said second coupling including pin means adapted to be disposed in a first position and a second position for fluidly connecting said third further tubing to said second further tubing when disposed in said first position and fluidly disconnecting said third further tubing from said second further tubing when disposed in said second position.

9. The apparatus of claim 8, wherein the pin means in said first coupling and said second coupling comprises a rotatable elongated member adapted to be rotated between said first position and said second position.

10. The apparatus of claim 7, wherein said pin means in said first coupling comprises fill nipple means for enabling a fluid to fill said second further tubing without also filling said first further tubing when said pin means is disposed in said second position.

11. Apparatus adapted to be connected between a tubing and a pressure controlled device for operating said device, comprising:

first means for defining a first fluid passage adapted to be connected to said tubing;

second means for defining a second fluid passage adapted to be connected to said pressure controlled device;

third means for defining a third fluid passage adapted for receiving a fluid; and fluid connection means fluidly connected between said first means, said second means, and said third means for preventing fluid communication between said first fluid passage and said second fluid passage and allowing fluid communication between said first fluid passage and said third fluid passage when said fluid connection means is disposed in a first position, said fluid from said third means filling said first means and said tubing when said fluid connection means allows fluid communication between said first fluid passage and said third fluid passage, said fluid connection means allowing fluid communication between said first fluid passage and said second fluid passage and preventing fluid communication between said first fluid passage and said third fluid passage when said fluid connection means is disposed in a second position, said fluid in said tubing pressurizing said first means, said second means, and said pressure controlled device and operating said device when said fluid connection means allows fluid communication between said first fluid passage and said second fluid passage.

12. The apparatus of claim 11, wherein said pressure controlled device is a firing head.

13. The apparatus of claim 11, wherein said pressure controlled device is a firing head disposed in a perforating apparatus adapted to be disposed in a wellbore.

14. In a system including a tubing, a device, and an apparatus adapted to be placed in a first condition and a second condition and fluidly interconnected between said tubing and said device, said apparatus including a first means defining a first passage fluidly connected to said tubing, a second means defining a second passage fluidly connected to said device, and a third means defining a third passage adapted to receive a fluid and to fill said tubing with said fluid, a method of operating said device comprising the steps of:

placing said apparatus in said first condition;

when said apparatus is placed in said first condition, introducing said fluid into said third means of said apparatus, said fluid being allowed to fill said third passage, said first passage, and said tubing but being prevented from filling said second passage and operating said device when said apparatus is placed in said first condition;

placing said apparatus in said second condition;

when said apparatus is placed in said second condition, pressurizing said fluid in said tubing and said first passage, the pressurized fluid in said tubing and said first passage being prevented from entering and pressurizing the fluid in said third passage but being allowed to enter said second passage when said apparatus is placed in said second condition, said device being operated when the pressurized fluid in said tubing and said first passage enters said second passage.

15. The system of claim 14, wherein said device is a pressure controllable firing head.

16. The system of claim 14, wherein said device is a pressure controllable firing head in a perforating gun adapted to be disposed in a wellbore.

17. A method of detonating a firing head in a perforating gun by pressurizing a fluid disposed in a tubing, a safety pin being connected between said tubing and said device, comprising the steps of:

placing said safety pin in a first position thereby closing off fluid communication between said tubing and said device and opening fluid communication between a fill nipple and said tubing;

filling said tubing with fluid via said fill nipple when said safety pin is placed in said first position;

placing said safety pin in a second position thereby opening fluid communication between said tubing and said device and closing off fluid communication between said fill nipple and said tubing; and pressurizing said fluid in said tubing, said firing head being detonated in response to the pressure, said perforating gun detonating in response to detonation of the firing head.

* * * * *

UNITED STATES PATENT AND TRADEMARK OFFICE

CERTIFICATE OF CORRECTION

PATENT NO. : 5,277,262

DATED : Jan. 11, 1994

INVENTOR(S) : Huber et al

It is certified that error appears in the above-identified patent and that said Letters Patent is hereby corrected as shown below:

Column 10,

Claim 17, line 3, change "and said" to -- and a --.

Signed and Sealed this

Sixteenth Day of August, 1994

Bruce Lehman

*Attest:*

BRUCE LEHMAN

*Attesting Officer*

*Commissioner of Patents and Trademarks*